US009623990B2

(12) United States Patent
Cirio

(10) Patent No.: US 9,623,990 B2
(45) Date of Patent: Apr. 18, 2017

(54) MACHINE FOR APPLYING THREADED CAPS TO CONTAINERS

(71) Applicant: AROL S.p.A., Canelli (Asti) (IT)

(72) Inventor: Sergio Cirio, Canelli (IT)

(73) Assignee: Arol S.p.A., Canelli (ASTI) (IT)

( * ) Notice: Subject to any disclaimer, the term of this patent is extended or adjusted under 35 U.S.C. 154(b) by 528 days.

(21) Appl. No.: 14/167,817

(22) Filed: Jan. 29, 2014

(65) Prior Publication Data

US 2015/0033667 A1 Feb. 5, 2015

(30) Foreign Application Priority Data

Jul. 30, 2013 (IT) ..... TO2013A0644

(51) Int. Cl.

*B65B 7/28* (2006.01)
*B67B 3/20* (2006.01)
*B67B 3/26* (2006.01)

(52) U.S. Cl.

CPC ..... *B65B 7/2842* (2013.01); *B67B 3/2033* (2013.01); *B67B 3/264* (2013.01)

(58) Field of Classification Search

CPC ... B65B 7/2842; B65B 7/2828; B65B 7/2838; B65B 7/2835; B65B 7/28; B67B 3/2033; B67B 3/264; B67B 3/2073; B67B 3/2013; B67B 3/2066; B67B 3/26; B67B 3/261; B67B 3/262; B67B 3/28

USPC ..... 53/75, 329, 330, 331, 331.5, 367

See application file for complete search history.

(56) References Cited

U.S. PATENT DOCUMENTS 4,271,974 A * 6/1981 Quinard ..... B65D 41/0478 215/331
4,285,186 A * 8/1981 Desom ..... B67B 5/03 53/128.1
5,996,308 A * 12/1999 Nakamura ..... B65B 7/2807 53/167
6,105,343 A * 8/2000 Grove ..... B65B 7/2835 53/317

(Continued)

FOREIGN PATENT DOCUMENTS

CH WO 2011116902 A1 * 9/2011 ..... B67B 3/26
CH WO 2013060694 A1 * 5/2013 ..... B65D 41/0471

(Continued)

OTHER PUBLICATIONS

EPO Search Report for European Application No. 13197673.0, dated Mar. 25, 2014.

*Primary Examiner* — Hemant M Desai
*Assistant Examiner* — Valentin Neacsu
(74) *Attorney, Agent, or Firm* — Patterson & Sheridan, LLP

(57) ABSTRACT

Machine for applying threaded caps to containers, comprising: gripping means configured to hold the respective containers, at least one screwing head including a respective gripping member configured to hold a respective cap; at least one electric motor associated with said screwing head and configured to control a rotational movement of said gripping member about a longitudinal axis and a translational movement of said gripping member along said longitudinal axis, the translational movement and the rotational movement being synchronized with each other so as to move said gripping member along a screwing path.

10 Claims, 3 Drawing Sheets

(56) References Cited

U.S. PATENT DOCUMENTS

| | | | | |
|---|---|---|---|---|
| 6,519,913 | B2 * | 2/2003 | Higashizaki | B65B 7/2835 53/331.5 |
| 2001/0018820 | A1 * | 9/2001 | Kitamoto | B67B 3/20 53/490 |
| 2002/0116897 | A1 * | 8/2002 | Higashizaki | B65B 7/2835 53/331.5 |
| 2002/0196434 | A1 * | 12/2002 | Takakusaki | B67B 3/26 356/240.1 |
| 2003/0196519 | A1 * | 10/2003 | Graffin | B67B 3/26 81/3.2 |
| 2010/0049357 | A1 * | 2/2010 | Weil | B65C 9/06 700/213 |
| 2010/0089004 | A1 * | 4/2010 | Data | B67B 3/2033 53/317 |
| 2011/0083405 | A1 * | 4/2011 | Dewert | B67B 3/20 53/490 |
| 2012/0086143 | A1 * | 4/2012 | Huettner | G01B 11/26 264/40.1 |

FOREIGN PATENT DOCUMENTS

| | | | |
|---|---|---|---|
| JP | 2000327086 | A | 11/2000 |
| WO | 2011029617 | A2 | 3/2011 |
| WO | 2012169472 | A1 | 12/2012 |

* cited by examiner

MACHINE FOR APPLYING THREADED CAPS TO CONTAINERS

CROSS-REFERENCE TO RELATED APPLICATIONS

This application claims benefit of Italian patent application number TO2013A000644, filed Jul. 30, 2013, which is herein incorporated by reference.

BACKGROUND OF THE INVENTION

Field of the Invention

The present invention relates to a machine for applying threaded caps to containers.

Description of Prior Art

A common technique for closing containers such as bottles and the like envisages forming an external thread on the neck of the containers and applying caps with an internal thread to the containers.

The machines usually used for applying threaded caps to containers comprise a carousel structure that picks up the containers to be closed and makes them advance along a circular path. The carousel structure carries a plurality of capping heads each of which is equipped with a respective cap-gripping member. The cap-gripping member is driven with a rotational movement about a respective longitudinal axis and a translational movement. The rotational movement and the translational movement of the gripping member are mutually synchronized so as to apply a screwing movement to the caps.

In more traditional solutions, the screwing movement of the caps onto the containers stops when a preset torque is reached. The screwing heads limit the maximum torque transmitted to the cap-applying member by means of clutches, for example of the magnetic type, or thanks to a current-limited electric motor.

These solutions are not entirely satisfactory because the scewing of the caps based on the maximum torque can produce defective closures.

To overcome these drawbacks, systems have already been proposed for applying threaded caps that apply a screwing stroke of preset angular amplitude starting from a condition of incipient coupling between the thread of the cap and the thread of the container.

EP-A1-1491490 describes a screwing head equipped with a torque sensor that detects the screwing torque applied to the cap during screwing onto the container. The measured torque rapidly increases in the position wherein the threads of the cap and of the container come into mutual contact, in this way signalling the position of incipient coupling between the thread of the cap and the thread of the container. The cap is rotated by a predetermined angle with reference to the position of incipient coupling.

US2011/0083405-A1 describes a screwing head that detects the condition of incipient coupling between the cap and the container by measuring the current absorbed by the motor which drives the screwing head.

In these known solutions the condition of incipient coupling between the threads is detected after the cap is applied onto the container. A part of the working stroke of the screwing head is used for the recognition of the position of incipient coupling between the cap and the container rather than for the actual screwing of the cap. Consequently, in these known solutions a reduced angular stroke is available for the actual screwing of the cap.

SUMMARY OF THE INVENTION

The present invention aims to provide a machine for applying threaded caps to containers which overcomes the problems of the prior art.

According to the present invention, this object is achieved by a machine having the characteristics forming the subject of Claim 1.

The claims form an integral part of the disclosure provided in relation to the invention.

BRIEF DESCRIPTION OF THE DRAWINGS

The present invention will now be described in detail with reference to the attached drawings, provided purely by way of non-limiting example, wherein.

DETAILED DESCRIPTION

Figure 1:
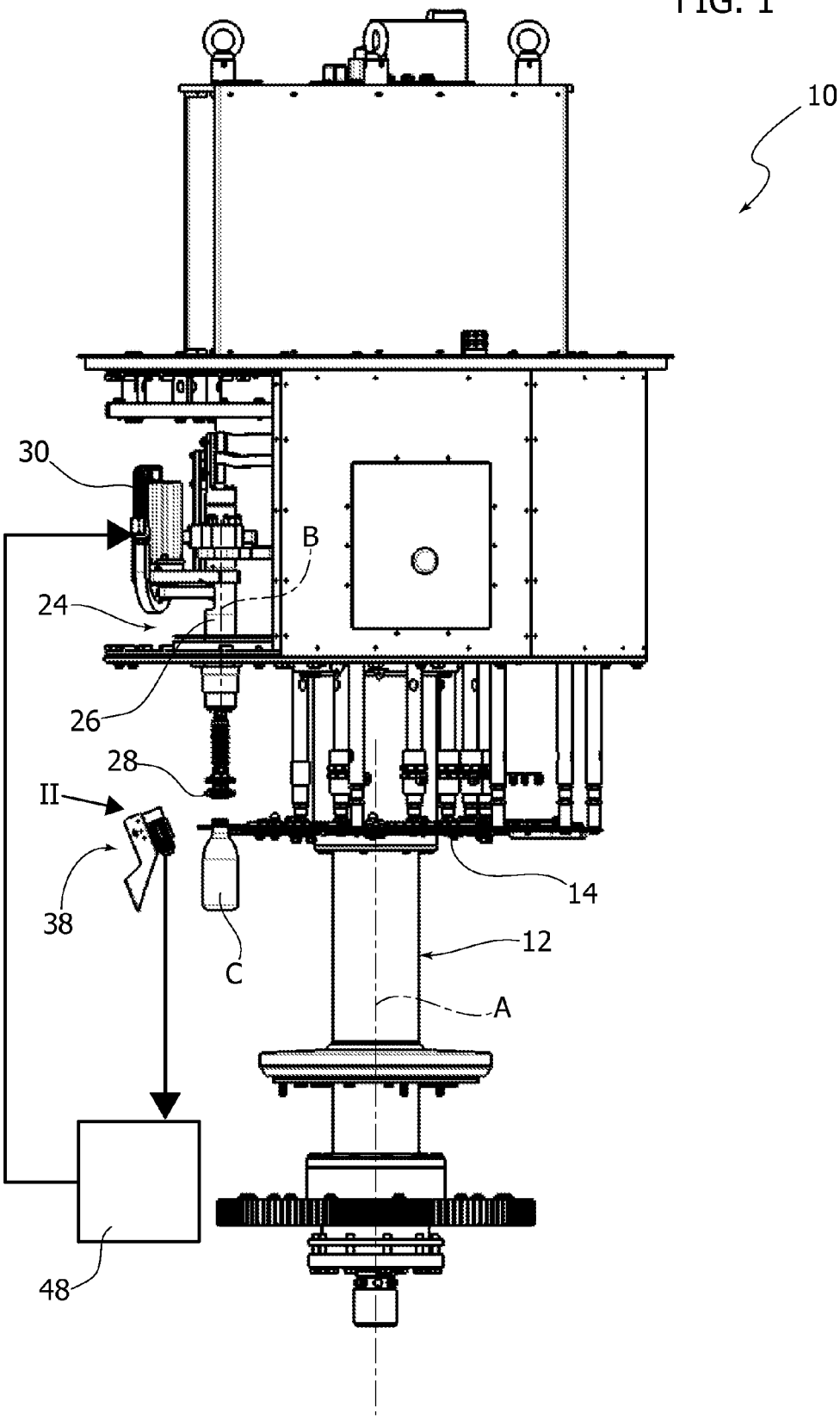
FIG. 1 is a schematic side view of a machine for applying threaded caps to containers.

With reference to FIG. 1, numeral 10 indicates a machine for applying threaded caps to containers C, such as bottles or the like. The machine 10 comprises a central column 12 rotatable about a vertical axis A. The central column 12 carries a turret 14 equipped with a plurality of means for gripping the containers C. The means for gripping the containers C are known per se and can be of various types depending on the type of containers C. In general, the gripping means of the bottles must ensure a radial and axial retention of the bottle and must also have an anti-rotation element which prevents rotation of the bottle about its vertical axis.

In the illustrated example, the turret 14 is equipped with an external guide 20 and fork elements 22 configured to receive respective necks of the containers C, and equipped with respective anti-rotation elements. It is intended that the system represented in the figures is only an example of a possible gripping means and that the invention is applicable to any other system for gripping the containers C.

Figure 2:
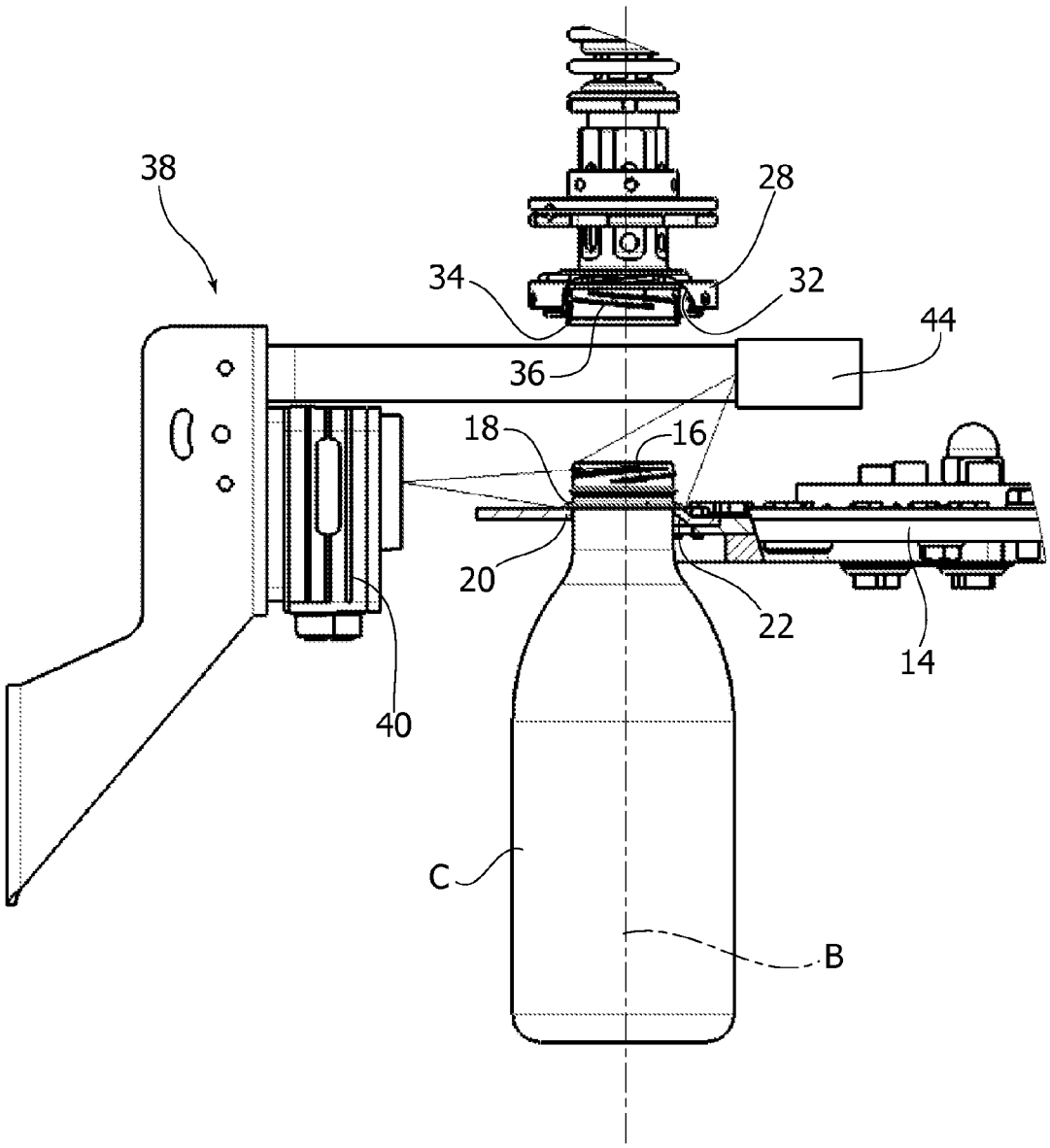
FIGS. 2 and 3 are views in greater detail of the parts indicated by the arrow II in FIG. 1.
Figure 3:
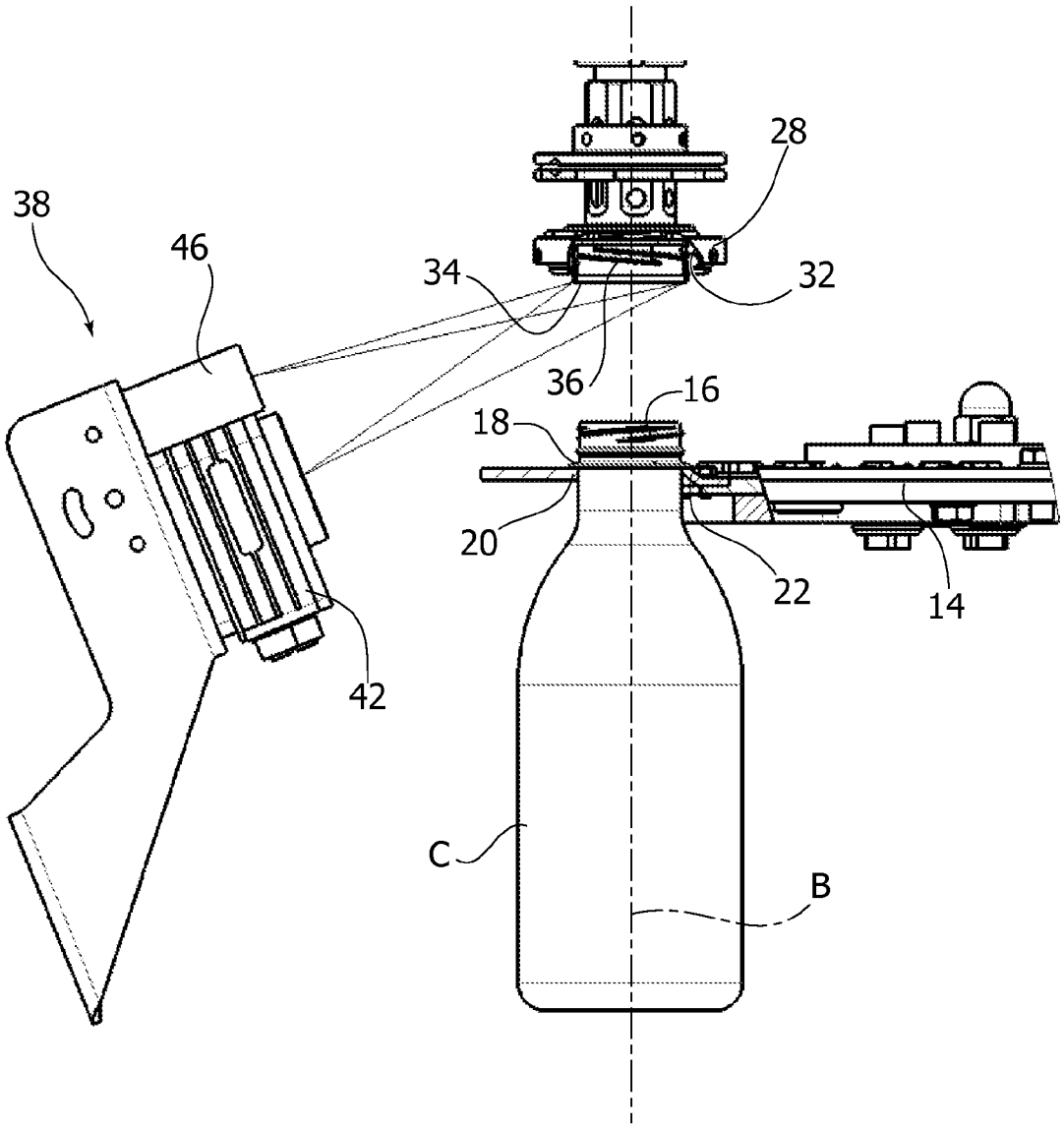

As illustrated in greater detail in FIGS. 2 and 3, the containers C are provided with an external thread 16 configured for receiving a threaded cap. At the base of the thread 16 of the containers C a radially projecting rim 18 is formed.

With reference to FIG. 1, the machine 10 comprises a plurality of screwing heads 24. Each screwing head 24 is located above a respective gripping means of the containers C. Each screwing head 24 comprises a spindle 26 carrying a cap-gripping member 28 at its lower end. Each screwing head 24 has a respective electric motor 30 which imparts a rotational movement to the spindle 26 about a respective longitudinal axis B. The cap-gripping member 28 performs a rotational movement about the axis B and a translational movement in the direction of the axis B. The rotational movement and the translational movement are synchronized with each other, so that during operation the caps held by the gripping members 28 are applied with a screwing movement. The linear movement in the direction of the axis B of the cap-gripping member 28 can be obtained by means of a mechanical or electronic cam. The structure and operation of the screwing heads 24 are known per se and do not require a more detailed description as they are beyond the scope of the present invention. The maximum torque applied to the cap-gripping member 28 is limited by the current supplied to the motor 30.

With reference to FIGS. 2 and 3, the cap-gripping member 28 of each screwing head 24 has a frusto-conical seat 32 configured for receiving and retaining a respective cap 34. The cap 34 has a respective internal thread 36 which is designed to couple with the external thread 16 of the respective container C.

The machine 10 according to the present invention comprises a vision system 38 which is used for detecting the angular position of the threads 16 of the containers C and the angular position of the threads 36 of the caps 34. More precisely, the vision system 38 is used to detect the angular position of the start points of the threads 16 and 36.

The vision system 38 can comprise a first viewing device 40 (FIG. 2) for detecting the angular position of the start point of the external thread 16 of a container C, and a second vision device 42 (FIG. 3) for detecting the angular position of the start point of the internal thread 36 of a cap 34 held by the gripping member 28. Each vision device 40, 42 can be associated with a respective illuminator 44, 46 arranged to illuminate the respective area of vision.

As illustrated in FIGS. 2 and 3, the vision devices 40, 42 and the respective illuminators 44 and 46 may be arranged outside of the turret 14. Alternatively, the vision devices 40, 42 can be axially aligned with the caps 34 and containers C.

The vision system 38 is in a fixed position and detects images of the threads 16, 36 of the containers C and the caps 34 which, from time to time, pass in front of the vision system 38. The images recorded by the vision system 28 are sent to an electronic control unit schematically indicated with numeral 48 in FIG. 1. The electronic control unit 48 has an algorithm that analyses the images detected by the vision devices 40, 42 and determines the angular position with respect to a reference system of the start point of the external thread 16 of the container C and the start point of the internal thread 36 of the corresponding cap 34.

The electronic control unit 48 is configured to control the electric motors 30 of the screwing heads 24 in order to make an adjustment of the angular position of the caps 34 according to the information on the detected angular position of the threads 16, 36. The adjustment of the angular position of the caps 34 consists in a rotation about the axis B of the gripping members 28. This adjustment can be carried out before applying the caps 34 to the respective containers C.

Alternatively, the adjustment of the angular position of the caps can be carried out after the caps 34 have been placed on the threads 16 of the respective containers C. In this case, an angular stroke equal to the sum of the screwing angle of the caps and the displacement angle between the thread of the cap and the thread of the container is applied to each cap 34.

The purpose of the adjustment movement is to arrange the caps 34 with respect to the containers C so that the threads 36 of the caps 34 are in a preset angular position with respect to the threads 16 of the respective containers C.

Starting from the position in which the caps 34 are juxtaposed to the containers C with the threads 36, 16 in a predetermined angular position, the motors 30 apply an angular rotation about the axis B, with a predetermined amplitude, to the respective gripping members 28. In this way, the screwing stroke of the caps 34 is determined on the basis of a geometric criterion rather than as a function of the screwing torque. This allows a greater precision of screwing to be obtained and the avoidance of defects in the closing of the containers due to an excessive or insufficient closing torque.

In parallel to the control of the motors 30 on the basis of a predetermined screwing stroke, the electronic control unit 48 can also carry out a detection of the screwing torque applied to the caps 34 by any known method for torque detection. The electronic control unit 48 may be programmed to vary the screwing stroke with respect to the established preset value in case the measured closing torque is insufficient or excessive.

The vision system 38 is able to recognize the threads 36 of caps with different sizes, different colours and different numbers of thread elements (from 1 to n elements). The vision system 38 is also able to recognize interruptions of the threads and the thread sectors with zero slope. The vision system 38 is also able to detect the thread of transparent glass or plastic containers.

Of course, without prejudice to the principle of the invention, the details of construction and the embodiments may vary widely with respect to those described and illustrated without departing from the scope of the invention as defined by the claims that follow.

The invention claimed is:

1. Machine for applying threaded caps to containers, comprising:

a holding device configured for holding a respective container, the respective container having an external thread;

at least one screwing head including a gripping member, the grippinq member configured for holding a respective cap, the respective cap having an inner thread;

at least one electric motor associated with the at least one screwing head and configured to control a rotational movement of the gripping member about a longitudinal axis of the gripping member, wherein the gripping member performs a translational movement along the longitudinal axis synchronized with the rotational movement so that during operation, the gripping member moves along a screwing path;

at least one vision system configured for detecting images of the external thread of the respective container and of the inner thread of the respective cap held by the gripping member, the at least one vision system comprising:

a first vision device, wherein the first device detects images of the external thread of the respective container; and a second vision device, wherein the second vision device detects images of the inner thread of the respective cap; and an electronic control unit configured to process the images of the external thread and inner thread and to determine an angular position of a start point of the external thread of the respective container and an angular position of a start point of the inner thread of the respective cap and for controlling an adjustment of angular position of the respective cap so as to carry out screwing of the cap onto the respective container with the respective inner thread arranged in a preset relative position.

2. Machine according to claim 1, wherein the first and second vision devices comprise respective illuminators arranged to illuminate respective vision zones of the first and second vision devices.

3. Machine according to claim 1, wherein the electronic control unit is configured to process the images of the external thread and inner thread, detected by the at least one vision system in order to determine the angular position of the start point of the external thread of the container and the angular position of the start point of the inner thread of the respective cap with respect to a common reference system.

4. Machine according to claim 1, wherein the electronic control unit is also configured to control the electric motor of the at least one screwing head according to a measured torque applied to the respective cap.

5. The machine according to claim 1, wherein the second vision device is inclined upwardly to detect images of the inner thread of the respective cap.

6. A machine for applying threaded caps to containers, comprising a central column rotatable about a longitudinal axis;

a turret coupled to and rotationally fixed with respect to the central column, comprising at least one guide having a fork element at one end of the guide, wherein the fork element receives a neck of a container;

at least one screwing head disposed above the at least one guide, the at least one screwing head comprising:

a spindle having a seat disposed at one end of the spindle, wherein the seat receives a cap and wherein the spindle is movable parallel to the longitudinal axis; and a motor coupled to the spindle, wherein the motor rotates the spindle with respect to the turret;

at least one vision system fixed relative to the central column, comprising:

a first vision device, wherein the first vision device records images of a thread of the container; and a second vision device, wherein the second vision device records images of an inner thread of the cap;

an electronic control unit configured to receive the images of the thread of the container and of the inner thread of the cap, recorded by the at least one vision system, wherein the electronic control unit processes the images of the thread of the container and of the inner thread of the cap and wherein the electronic control unit determines an angular position of a start point of the thread of the container and an angular position of a start point of the inner thread of the cap, the electronic control unit being configured to control an adjustment of an angular position of the cap relative to the container, so as to carry out screwing of the cap onto the container.

7. The machine according to claim 6, wherein the first and second vision devices comprise respective illuminators arranged to illuminate respective vision zones of the first and second vision devices.

8. The machine according to claim 6, wherein the electronic control unit determines the angular position of the start point of the thread of the container and the angular position of the start point of the inner thread of the cap with respect to a common reference system.

9. The machine according to claim 6, wherein the electronic control unit measures a torque applied to the cap.

10. The machine according to claim 9, wherein the electronic control unit adjusts the motor of the at least one screwing head based on measured torque applied to the cap.

* * * * *